United States Patent [19]

Wood

[11] Patent Number: 4,494,901

[45] Date of Patent: Jan. 22, 1985

[54] ALIGNING STACKS OF SHEETS

[75] Inventor: David Wood, Bristol, England

[73] Assignee: Jagenberg AG, Dusseldorf, Fed. Rep. of Germany

[21] Appl. No.: 404,198

[22] Filed: Jul. 30, 1982

[30] Foreign Application Priority Data

Aug. 4, 1981 [GB] United Kingdom ..... 8123832

[51] Int. Cl.[3] ..... B65H 31/34

[52] U.S. Cl. ..... 414/28; 271/221; 414/35; 414/786

[58] Field of Search ..... 271/221, 222; 414/28, 414/35, 36, 37, 786, 113, 114, 115

[56] References Cited

U.S. PATENT DOCUMENTS 4,132,400 1/1979 Naramore ..... 271/221

FOREIGN PATENT DOCUMENTS 284911 2/1928 United Kingdom ..... 271/221

*Primary Examiner*—Robert J. Spar
*Assistant Examiner*—Janice Krizek
*Attorney, Agent, or Firm*—Sprung, Horn, Kramer & Woods

[57] ABSTRACT

The method of aligning successive stacks of sheets each having a lower portion and an upper portion off-set comprises horizontally feeding each stack with the off-set edge of the upper portion leading towards a horizontally disposed sheet separating blade to a position at which the offset edge overhangs the blade. Relative vertical movement between the blade and the stack is effected until the blade has partly lifted the offset edge of the upper portion. Relative horizontal movement between the blade and the lower portion of the stack is next effected by pushers to cause penetration of the blade between the upper and lower portions followed by abutment with the offset edge to bring the upper portion into alignment with the lower portion.

2 Claims, 6 Drawing Figures

FIG. 3
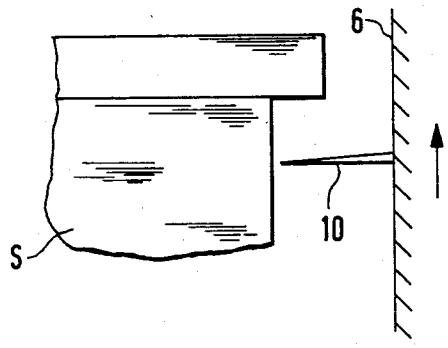
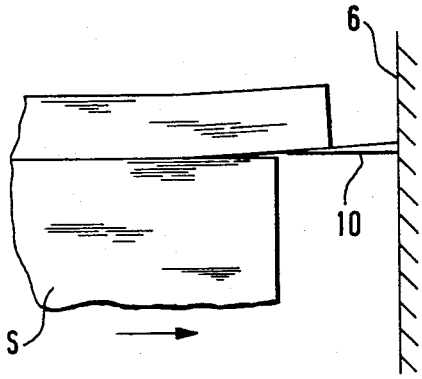
FIG. 4
FIG. 5
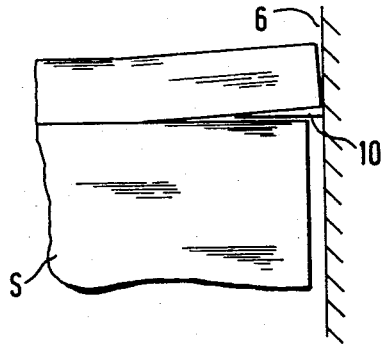

ALIGNING STACKS OF SHEETS

This invention relates to a method of and apparatus for aligning stacks of sheets, notably sheets of paper which are formed into batches or reams prior to packaging in cartons.

In co-pending European application No. 81301525.2 there is disclosed a sheet stacking apparatus in which the stack is formed in an alternating offset manner having a configuration of toothed appearance when viewed from the side. As described therein the number of sheets in adjacent offset portions may be equal, so that each portion corresponds to a desired batch or ream (e.g. 500 sheets). Alternatively where larger batches are required (e.g. for the U.S.A. market) the apparatus may produce offset portions at one side which are smaller in size than the intermediate alternating portions of the other side, so that each required batch consists of a large portion and a small offset portion above the large portion. After each such individual composite batch has been removed from the formed stack in a manner described therein, it then becomes necessary to provide reliable and automatic means for aligning the small portion relative to the underlying large portion.

According to the present invention there is provided a method of aligning successive stacks of sheets, each having a lower portion and an upper portion offset therefrom, comprising the steps of horizontally feeding each stack, with the offset edge of the upper portion leading, towards a horizontally disposed sheet separating blade to a position at which said offset edge overhangs the blade, effecting relative vertical movement between the blade and the stack until the blade has partly lifted said offset edge of the upper portion, and effecting relative horizontal movement between the blade and the lower portion of the stack to cause penetration of the blade in between said portions followed by abutment with said offset edge, so as to bring the upper portion into alignment with the lower portion.

Preferably the step of effecting relative horizontal movement is performed in two discrete movements, comprising a first movement along a predetermined distance, and a second and shorter movement produced by applying a horizontal force to the stack over a predetermined period of time.

The invention also extends to apparatus for performing said method of aligning, comprising a horizontal air table, means for feeding successive stacks onto one end of the table, a vertical backboard at the other end of the table, a horizontally disposed sheet-separating blade projecting from the backboard and movable vertically, a first pusher movable along the air table between said feeding means and said backboard in a direction perpendicular to said backboard, and a second pusher movable across the air table parallel to said backboard to push the aligned stack transversely away from the table and blade.

Said first pusher preferably has means mounting the pusher for pivotal movement away from its operative position above the air table, so as to allow the feeding means to feed a stack onto said one end of the table under said first pusher. Said mounting means may comprise a toggle linkage to lock the pusher in its operative position.

An example of apparatus according to the invention will now be described with reference to the accompanying drawings in which:

FIGS. 3 to 5 are enlarged side views showing successive stages in the operation of the air sword of the apparatus of FIG. 1.

Figure 1:
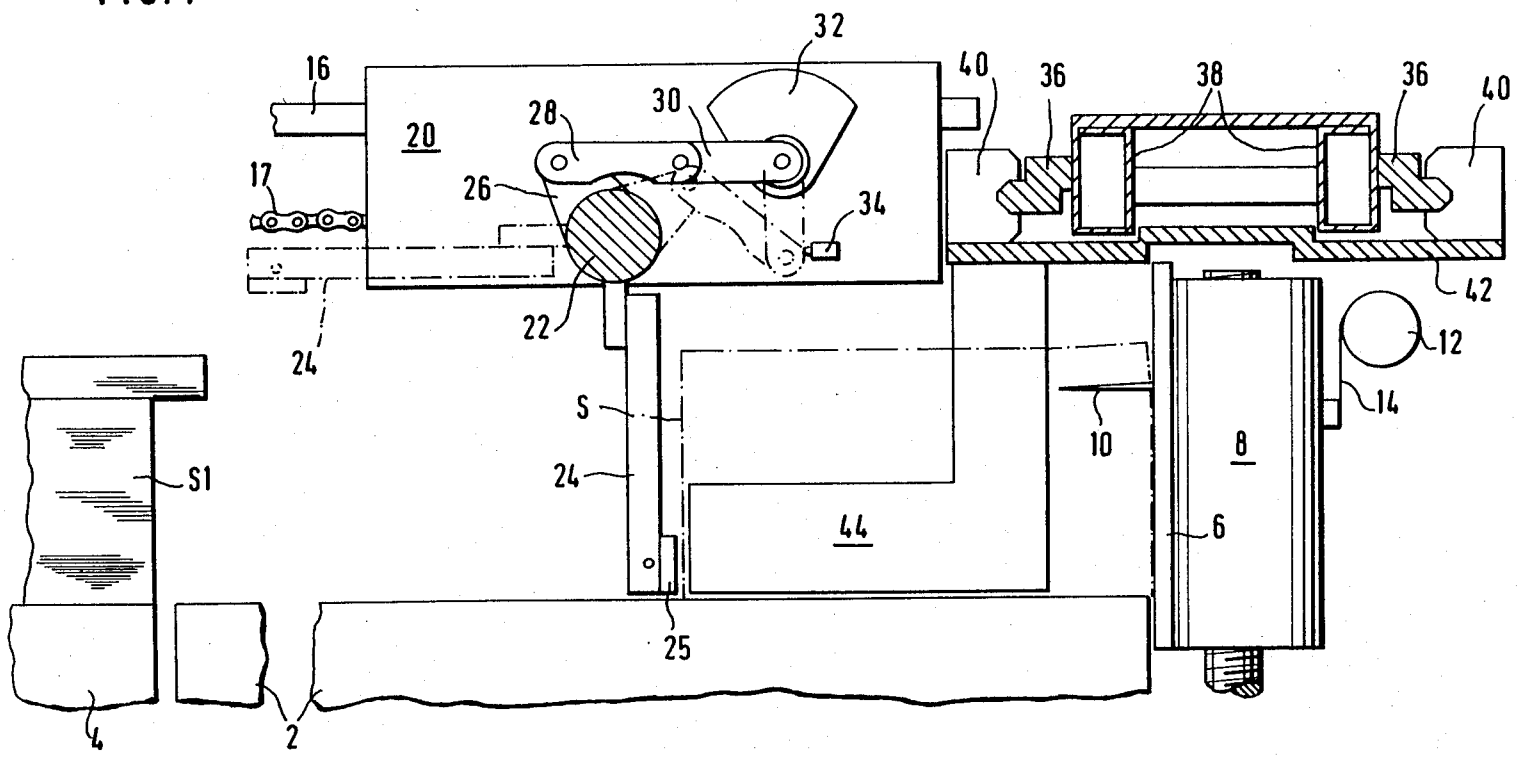
FIG. 1 is a side view of the apparatus partly in section.
Figure 2:
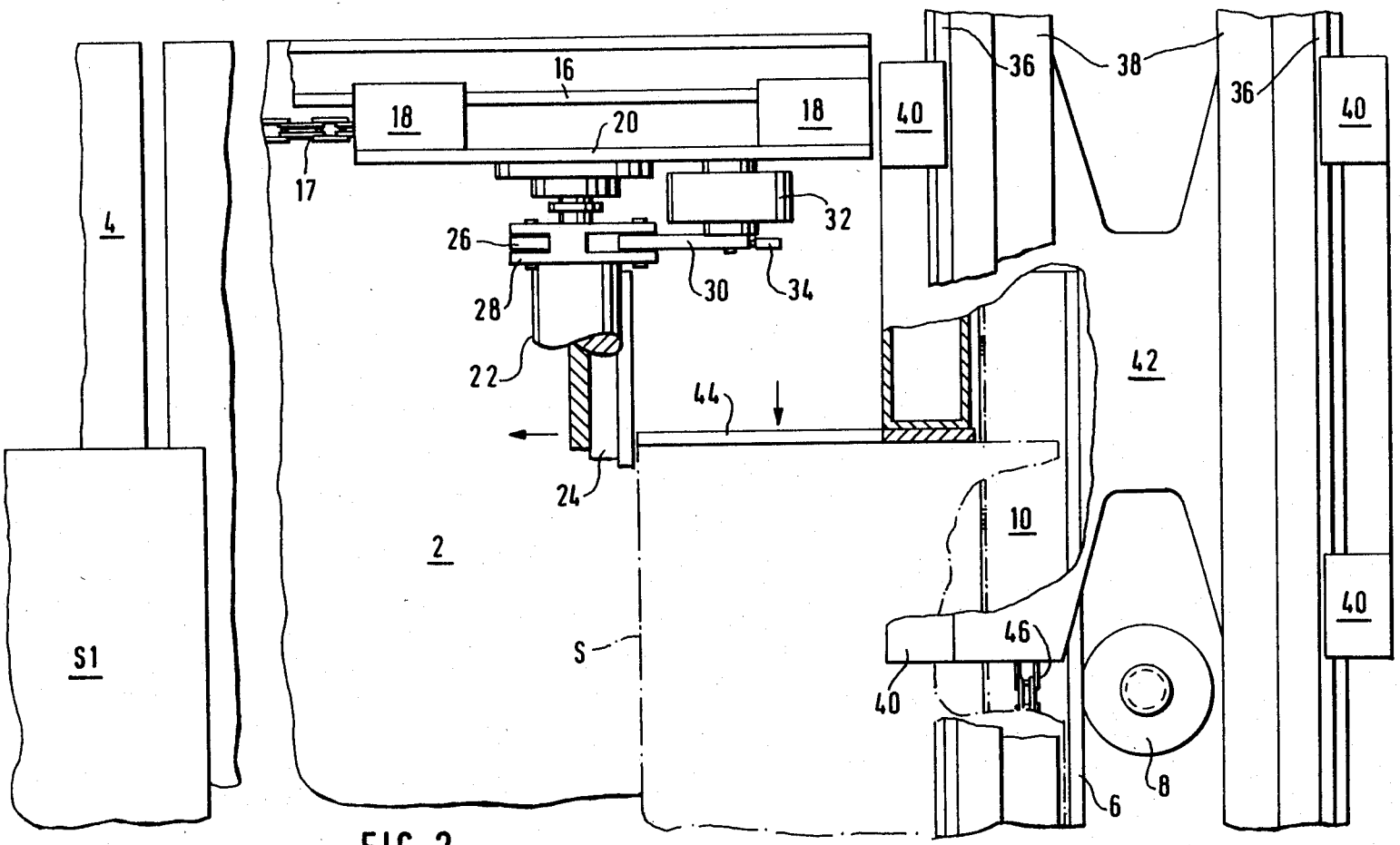
FIG. 2 is a plan view, shown partly in section and with some parts broken away.

Referring first to FIGS. 1 and 2 there is shown an air table 2 formed with a pattern of known air apertures (not shown) connected to a controlled supply of air pressure, and supporting a ream or stack of paper sheets S, shown for the sake of clarity in chain-dotted outline. To the left of the table 2 is another air table 4 supporting a previous similar stack of sheets S1, shown in solid lines.

Each stack S and S1 is of a height up to about 250 mm and commonly weighs 160 lbs, and is to be packed by a subsequent machine into a carton. As received on the table 4 each stack has its upper portion staggered or offset towards the right relative to its main lower portion, this being the configuration in which it is separated from a continuously formed staggered stack on a sheet stacking machine as described in the above-mentioned copending European application No. 81301525.2. The purpose of the apparatus now to be described is to realign such upper portion with the remainder of the stack.

It will be seen from FIG. 2 that only one side of the apparatus, including the air tables 2 and 4, is shown. The other side, except where mentioned below, is a mirror image to the side shown.

The width between the two sides is sufficient to accept several adjacent stacks, of a total width or "deckle" of up to 2 meters. For convenience, however, only a single stack will be referred to.

Extending along the right-hand edge of the table 2 is a vertical backboard 6 having a smooth surface against which the leading edges of the stacks are to be pushed to bring them into alignment. The backboard is supported for movement in a vertical direction by two screw jack mechanisms 8, only one of which can be seen. Secured horizontally to the smooth vertical surface of the backboard, along its entire width, is a short tapered air sword 10 formed along its pointed edge with a plurality of equi-spaced apertures which are connected behind the backboard to a controlled supply of air pressure, such as a pump (not shown). The vertical position of the screw mechanism 8, and hence of the air sword, is imparted to an encoder 12 by a toothed belt 14 which passes around the encoder, the free end being secured to the vertically movable body of the screw mechanism 8.

Above the table 2 are mounted a pair of rails 16 (only one shown) which extend horizontally between the table 4 and a point short of the backboard 6. Movable along each rail 16 by means of a driven chain 17 are a pair of slider blocks 18, FIG. 2, (e.g. Hepco heavy duty types of slider blocks) which are connected together by a plate 20. Extending between the plates 20 at each side of the apparatus is a pivotal shaft 22 to which is fixed a pusher blade 24 mounted for movement through an angle of about 90°. At the end of the blade 24 is a pusher head 25 having a small clearance from the table 2 and engageable with the back edge of the stack S. Secured to each end of the shaft 22 is a crank 26 to which is connected one end of a forked toggle link 28, the other end being connected to a rotatable arm 30 driven by an arcuate arm ram 32.

Anti-clockwise rotation of the arm 30 through an angle of 90° at first releases the toggle link 28 and then causes the shaft 22 and the blade 24 to rotate clockwise at a progressively increasing velocity ratio through an angle also of about 90° to bring the blade 24 to the chain-dotted position shown in FIG. 1. Completion of the anti-clockwise rotation of the arm 30 is detected by a microswitch 34 at one side of the apparatus.

A pair of rails 36, similar to the rails 16, are mounted at opposite sides of a fixed box frame 38 extending across the table 2 above the backboard 6. Slideably supported from the rails 36 on two pairs of slider blocks 40 (e.g. also Hepco heavy duty type) is a carriage 42 beneath which is rigidly mounted an L-shaped ejector plate 44. The bottom horizontal edge of the plate 44 is set at a small clearance above and parallel to the table 2, while the right-hand vertical edge of the plate extends at a similarly small clearance from the pointed free end of the air sword 10. Movement is imparted to the carriage 42 by a chain 46 connected to the ends of the carriage and passing around a driven sprocket (not shown).

A complete cycle of operations of the apparatus will now be described, with additional reference to FIGS. 3 to 5, and to the timing diagram of FIG. 6.

The cycle commences with the stack S1 positioned on the table 4, as shown in FIG. 1. The blade 24 is now in the raised chain-dotted position and the entire assembly associated with the plate 20 is at the extreme left-hand side, so that the blade 24 is in a raised position over the table 4. A chain pusher (not shown) on table 4 now slides the stack S1 to transfer it across to the table 2, air pressure being supplied to the apertures in the table 2. Initially this air pressure is high to reduce friction during transfer of the stack S1, but towards the end of movement of the stack its deceleration is assisted by reducing the air pressure to a lower level. Completion of this transfer initiates operation of the air ram 32 to bring the blade 24 down through an angle of 90° until the toggle link 28 and arm 30 are in the locked position shown in solid lines. The increasing and then decreasing speeds of the ram 32 are shown in FIG. 6 by the angular line A.

At the end of the downward movement of the blade 24 air pressure to the table 2 is again increased, and at the same time the blade 24 commences to move towards the right under the drive of the chain 17. When the pusher head 25 engages the back edge of the stack it commences to move the stack to the right until its main lower portion comes to within a short distance from the sword 10, as shown in FIG. 3. This movement is represented in FIG. 6 by the trapezoidal line B, and consists of a constant acceleration, a short constant speed, and then a constant deceleration to rest.

Figure 6:
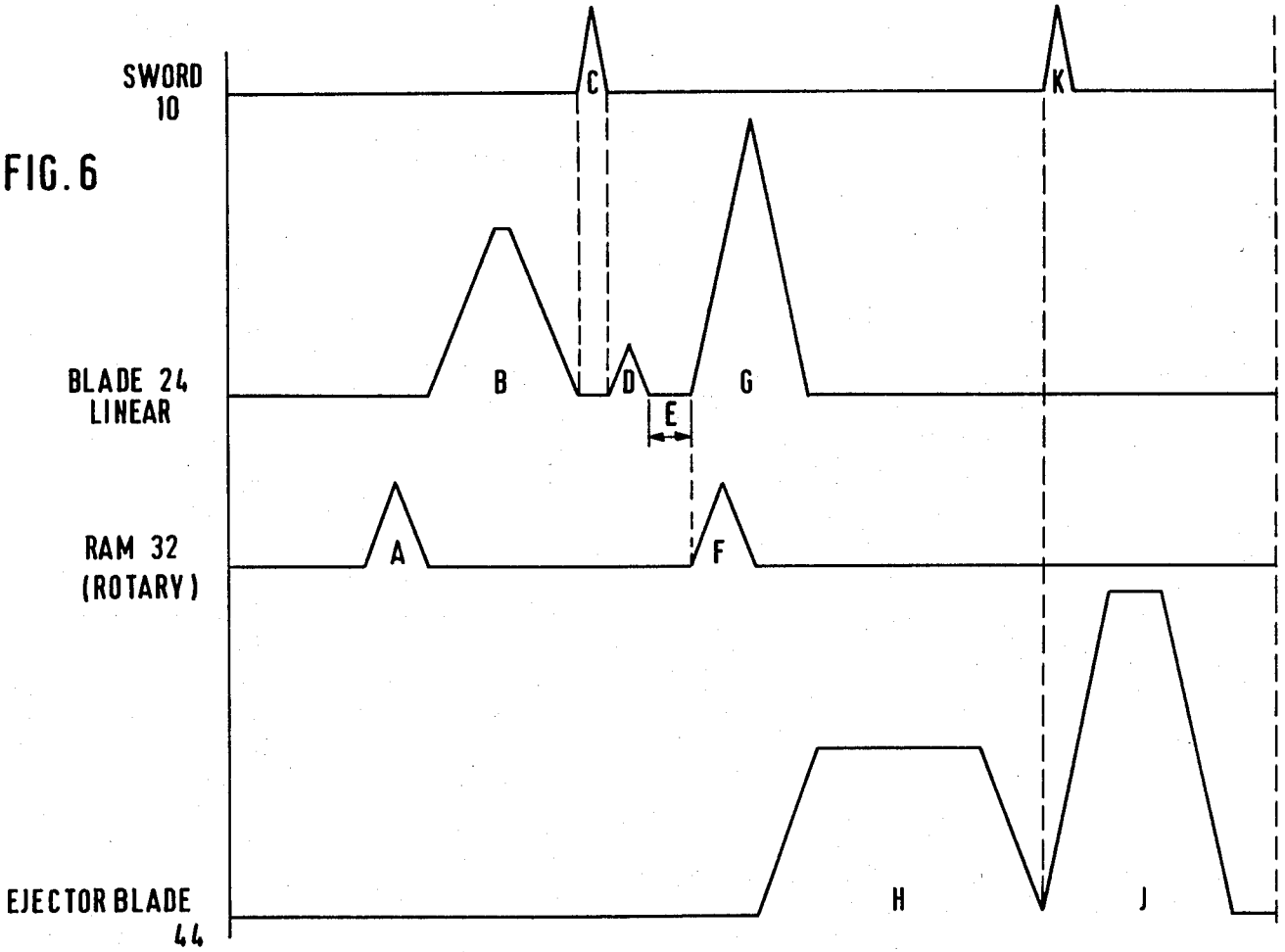
FIG. 6 is a velocity-time diagram of a complete cycle of operations of various parts of the apparatus.

The next operation, shown in FIG. 6 by the angular line C, is for the sword 10 to be lifted to the position of FIG. 4 in which it has raised the upper portion of the stack by about 5 mm. At the end of this movement air pressure is supplied to the apertures at the end of the sword 10. The blade 24 is next moved further towards the right until the lower portion of the stack is about 3 mm away from the backboard 6, this movement being shown by the short angular line D in FIG. 6. At the end of this movement the stack is at the position shown in FIG. 5, in which the sword 10 has penetrated between the upper and lower portions of the stack S, air pressure assisting lubrication between the sword and these portions. The upper portion has now engaged the backboard 6 and has been pushed to the left to bring it almost fully into alignment with the lower portion.

To complete the alignment of the upper portion of the stack, the motor (not shown) which drives the blade 24 via the chain 17, has a predetermined torque applied to it for a period of about 1 second. Thus the blade 24 also pushes the lower portion of the stack S fully against the backboard 6, aligning the upper and lower portions. This small movement occurs along the line E in FIG. 6, the motor then stalling for the remaining period of time.

Upon completion of alignment of the stack S, the pusher blade 24 is rotated by the ram 32 back to its chain-dotted position (the movement being indicated by the line F in FIG. 6), completion of this movement being detected by the microswitch 34. At the same time the entire assembly associated with the plate 20 is moved by the chain 17 back to the left, as shown by the angular line C.

As soon as the blade 24 has been fully lifted, i.e. been returned to the chain-dotted starting position, or the carriage supporting the blade 24 has moved the blade clear of the ejector plate 44, the drive commences to move the carriage 42 supporting the plate 44 into contact with the side of the stack S, as shown in FIG. 2. This movement is indicated in FIG. 6 by the trapezoidal line H, and comprises a period of constant acceleration, a period of constant speed, and finally a constant deceleration towards the end of the stroke of ejector plate 44. The aligned stack S is then transferred to a conveyor (not shown) for transport to a carton packing machine. During movement of the plate 44 the air supply to the sword 10 may be progressively turned off.

At the end of the movement of the ejector plate 44 the carriage 42 is immediately returned back to its starting position, this movement being indicated in FIG. 6 by the trapezoidal line J and comprising a rapid acceleration in the opposite direction, a short movement at a higher constant speed, and a final deceleration to rest at the starting point of the plate 44. Simultaneously with the start of the return of the plate 44 the sword descends as indicated by the angular line K.

As soon as the ejector plate 44 is back in its starting position (the blade 24 being in its upper position at the extreme left-hand end, as viewed in FIG. 1) the next unaligned stack on the table 4 may be transferred to the table 2 to commence a further cycle.

What is claimed is:

1. A method of aligning successive stacks of sheets, each having a lower portion and an upper portion offset therefrom, comprising the steps of horizontally feeding each stack, with the offset edge of the upper portion leading, towards a horizontally disposed sheet separating blade to a position at which said offset edge overhangs the blade, effecting relative vertical movement between the blade and the stack until the blade has partly lifted said offset edge of the upper portion, and effecting relative horizontal movement between the blade and the lower portion of the stack to cause penetration of the blade in between said portions followed by abutment with said offset edge, so as to bring the upper portion into alignment with the lower portion.

2. An apparatus for aligning successive stacks of sheets comprising a horizontal air table, means for feeding successive stacks onto one end of the table, a vertical backboard at the other end of the table, a horizontally disposed sheet-separating blade projecting from the backboard and movable vertically, a first pusher movable along the air table between said feeding means and said backboard in a direction perpendicular to said backboard, and a second pusher movable across the air table parallel to said backboard to push the aligned stack transversely away from the table and blade, whereby horizontally offset upper and lower portions of said stacks are vertically aligned by said first pusher pushing said stack portions against said backboard, said horizontally extending blade serving to penetrate between said upper and lower stack portions to facilitate their vertical alignment with each other.

* * * * *